United States Patent [19]

Armstrong et al.

[11] Patent Number: 4,770,411

[45] Date of Patent: Sep. 13, 1988

[54] EXERCISE APPARATUS ERGOMETER

[75] Inventors: Timothy O. Armstrong, Bellevue; Larry J. Graf, Snohomish; William W. Potts, Bellevue, all of Wash.

[73] Assignee: Precor Incorporated, Redmond, Wash.

[21] Appl. No.: 102,202

[22] Filed: Oct. 2, 1987

[51] Int. Cl.[4] ..... A63B 21/00; A61B 5/22

[52] U.S. Cl. ..... 272/73; 73/379; 272/DIG. 5

[58] Field of Search ..... 272/73, 69, 70, 97, 272/93; 128/25 R; 73/379, 380, 381, 862.12

[56] References Cited

U.S. PATENT DOCUMENTS

| | | | |
|---|---|---|---|
| 2,510,973 | 6/1950 | Guillemin | 272/73 |
| 3,833,216 | 9/1974 | Philbin | 272/73 |
| 4,558,861 | 12/1985 | Gall | 272/73 |
| 4,630,818 | 12/1986 | Saarinen | 73/379 |

*Primary Examiner*—Richard J. Apley
*Assistant Examiner*—S. R. Crow
*Attorney, Agent, or Firm*—Christensen, O'Connor, Johnson & Kindness

[57] ABSTRACT

An ergometer (28) is employed on an exercise cycle (10) having a flywheel (20) rotated by pedals (16). A selectively tensionable endless belt (26) extends around the perimeter of flywheel (20) and a separate strap (160) is attached to the endless belt (26) to extend tangentially from the flywheel (20). The opposite end of strap (160) is connected to one end of an indicator plate (162) with the other end of the indicator plate attached to one end of an extension spring (164). The extension spring (164) imparts a tensile load on strap (160) equal to the opposing tensile load on the strap (160) imposed by the frictional force acting between endless belt (26) and the flywheel (20). This force level is sensed by the movement of the indicator plate (162) which coincides with the extension of spring (164), which plate movement corresponds to the workout level being achieved. The workout level in terms of calories per minute is displayed by indicia disposed on the upper side of the indicator plate (162) visible through a window (30) formed in the frame structure (40) of the exercise cycle (10).

39 Claims, 3 Drawing Sheets

10
12
14
18
20
30
40
42
44
50
52
54
58
59
62
70
72
74
76
79
86
88
90
92
108
110
112
146
147
148
150
152
154
156

EXERCISE APPARATUS ERGOMETER

TECHNICAL FIELD

The present invention relates to ergometers for exercise equipment, with the ergometer being particularly adaptable for use with stationary exercise cycles.

BACKGROUND OF THE INVENTION

Various types of stationary equipment are now commonly used to provide aerobic exercise for persons who wish to keep physically fit, and also for therapy and rehabilitation purposes for patients who have suffered an illness or injury. Common forms of stationary exercise equipment for these purposes include exercise rowing machines, stair climbing machines, skiing machines, treadmills and cycles. Of these various types of exercise equipment, exercise cycles have an advantage in that they do not place high stress on the knees, ankles or backs, which could result from jogging or rowing.

In basic form, conventional stationary exercise cycles are constructed with a frame, together with a seat and handlebars mounted on the frame in the same positions relative to each other as on a typical bicycle. Pedals and associated cranks are used to drive a drum, wheel or flywheel using various types of drive trains, for instance, sprockets and a drive chain, pulleys and a drive belt or gears and a drive shaft. A resistance load is applied to the wheel, drum or flywheel by various techniques. Perhaps the most common technique is through the use of a band brake that extends around the periphery of the drum or flywheel. Examples of such exercise cycles are disclosed by U.S. Pat. Nos. 2,510,973; 3,833,216; 3,967,503; 3,995,491; 4,419,890; 4,533,136 and 4,592,544 and by British Pat. No. 1,464,540.

To be effective, aerobic exercising, including cycling, must place an increased load on the cardiovascular, respiratory and metabolic systems of the body, with the proper level of such loads dependent upon various factors such as the physical condition, health, size and age of the individual. Thus, it is desirable that exercise equipment, including stationary exercise cycles, be capable of measuring the work being expended by the individual to ensure that a proper workout level is being achieved and also to permit the workout level to be precisely repeatable.

In exercise cycles utilizing band brakes, a desired workout level is typically attained by varying the tension on the band brake, usually by imparting a tensile load on one end of the band brake. The tension on the band brake is measured using various techniques to quantify the energy being expended by the rider. For instance, in the above-mentioned '540 British patent, the tension on the band brake is applied by and measured with a spring device resembling a fish scale having a pointer directed at a series of graduations formed on the scale. In the '973 U.S. patent, the tension on the band brake is measured with a spiral spring having an associated pointer indicating the extent to which the spring has been wound, and in the above-noted '135 and '544 U.S. patents, the tension in the band brake is measured with a strain gauge producing an electrical output signal which is transmitted to a miroprocessor for computing the workout level. In the above-noted '890 U.S. patent, a weight is positioned between one end of the band brake and an anchoring spring. A pointer extends outwardly from the weight in the direction radially to the flywheel to terminate at an adjacent graduated scale. In the aforementioned '216 and '491 U.S. patents, the tension on the band brake is not measured directly, but rather is "ascertained" by the position of a hand lever used to apply the tensile load on the band brake.

Unfortunately, the foregoing energy measuring devices or ergometers are prone to inaccuracy due to the underlying assumption that the tension on the band brake is related to the work being expended by the rider in a repeatable, known relationship. However, the work being expended by the rider is in actuality related to the friction load between the band brake and the flywheel, which load is being overcome by the rider. For a given tension load on the band brake, this friction force varies with the coefficient of friction existing between the band brake and the flywheel. The coefficient of friction may be dependent upon numerous factors that change over time, for example, the extent of wear on the band brake, the atmospheric moisture and the cleanliness of the environment in which the cycle is located, etc. As a result, ergometers that measure the tensile load on the band brakes of stationary exercise cycles may not provide an accurate measurement of the force being overcome by the ride and, thus, the energy being expended by the rider.

SUMMARY OF THE INVENTION

The foregoing limitations of a known exercise equipment and, in particular, stationary exercise cycles, are addressed by the present invention. In the present invention, an exercise apparatus includes a circular member that is rotated during operation of the apparatus. A belt extends around at least a portion of the periphery of the rotatable member and is tensionable to impart a desired friction load between the belt and the rotatable member, thereby tending to cause the belt to rotate with the rotatable member. However, rotation of the belt is resisted by a line that is connected to the belt to extend tangentially to the circumference of the rotatable member. By interconnecting the line to the belt in this manner, the belt imparts tensile load on the line corresponding to the torque generated by the friction force existing between the belt and the rotatable member.

The opposite end of the line is connected to a resistance member to resist the load imposed on the line by the friction force acting between the belt and the flywheel. An indicator displays the level of resistance being applied to the line by the resistance member, which in turn corresponds to the level of work being expended by the operator of the exercise apparatus.

In another aspect of the present invention, the resistance member is elastic causing the line to move longitudinally a distance corresponding to the tensile load on the line. The indicator shifts with the movement of the resistance member and line, with the extent of the movement or shifting of the indicator corresponding with the level of workout being expended by the operator of the exercise apparatus.

In an additional aspect of the present invention, the indicator includes indicia disposed along the direction of movement of the indicator, with the indicia having values corresponding to the level of work being expended by the operator of the exercise apparatus. The particular indicia adjacent or corresponding to a reference location provides a visual indication of the workout level being achieved. In one specific aspect of the present invention, the indicator is disposed within the exercise apparatus, and the indicia on the indicator is visible through a viewing window formed in the apparatus.

BRIEF DESCRIPTION OF THE DRAWINGS

A typical embodiment of the present invention is illustrated in the accompanying drawings, wherein.

DETAILED DESCRIPTION OF THE INVENTION

Figure 1:
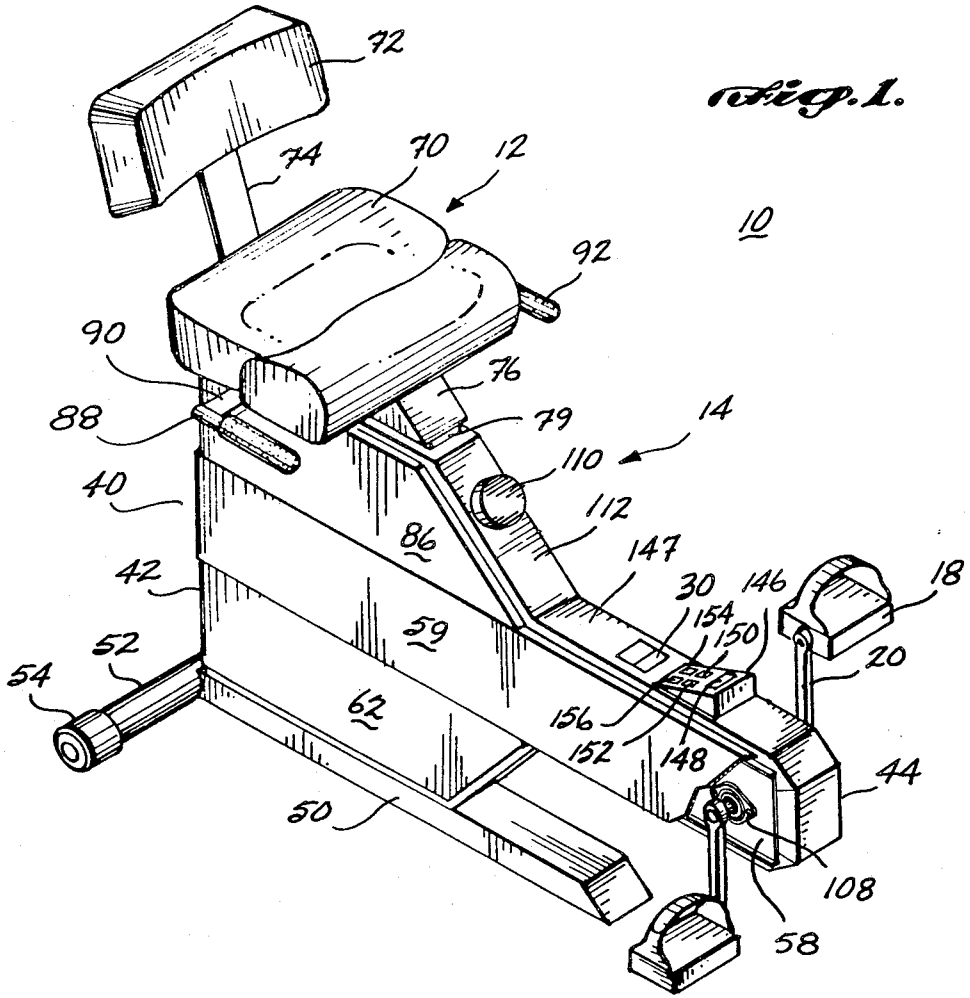
FIG. 1 is a front isometric view of a stationary exercise cycle in which the present invention has been incorporated.
Figure 2:
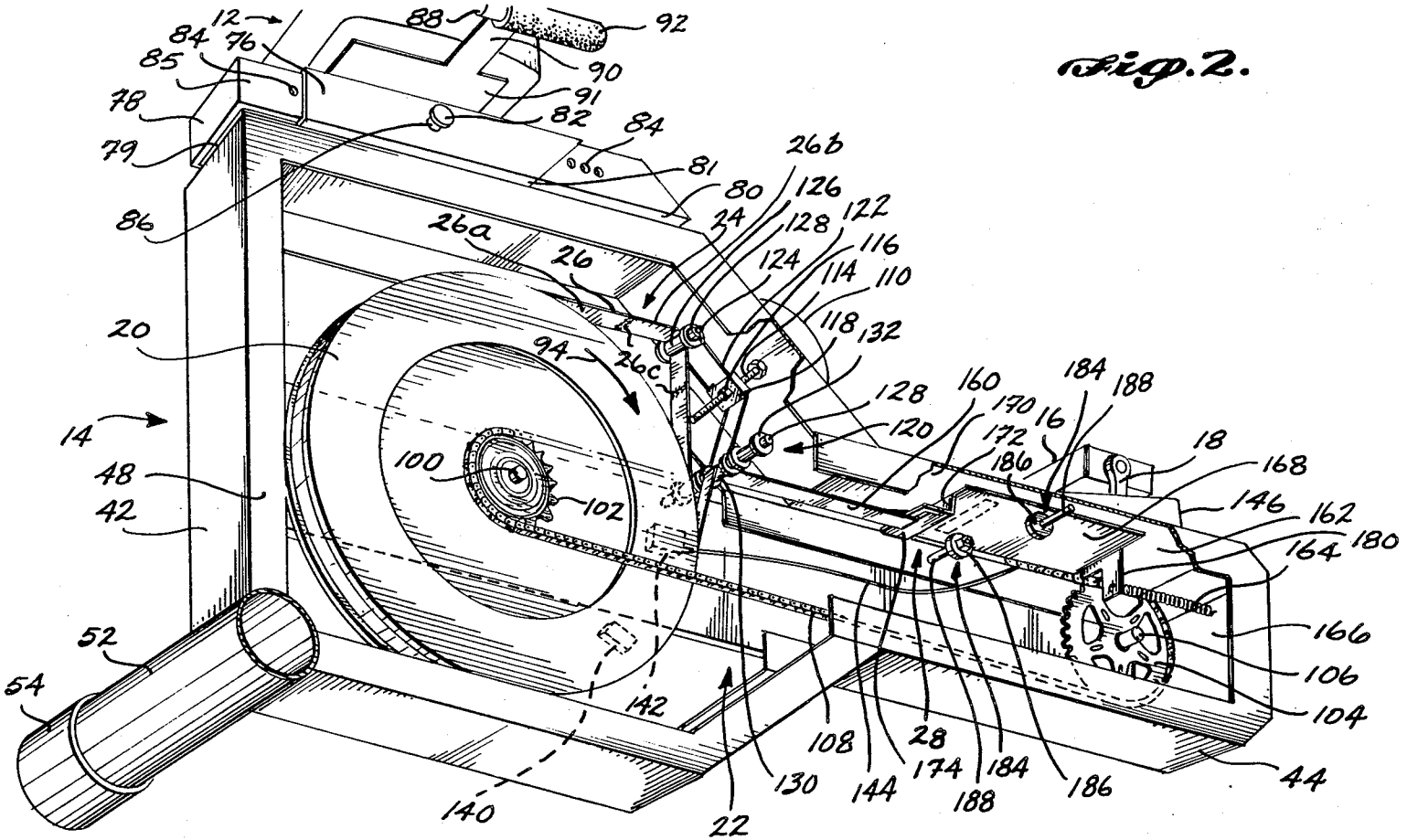
FIG. 2 is a rear isometric view of the stationary exercise cycle of FIG. 1 with portions removed or broken away to show the interior construction of the exercise cycle, including the ergometer of the present invention; and, FIG. 3 is an enlarged, fragmentary plan view of the exercise cycle of FIGS. 1 and 2 specifically depicting particular aspects of the ergometer of the present invention and, in particular, the manner in which the work being expended by the exerciser is visually displayed.
Figure 3:
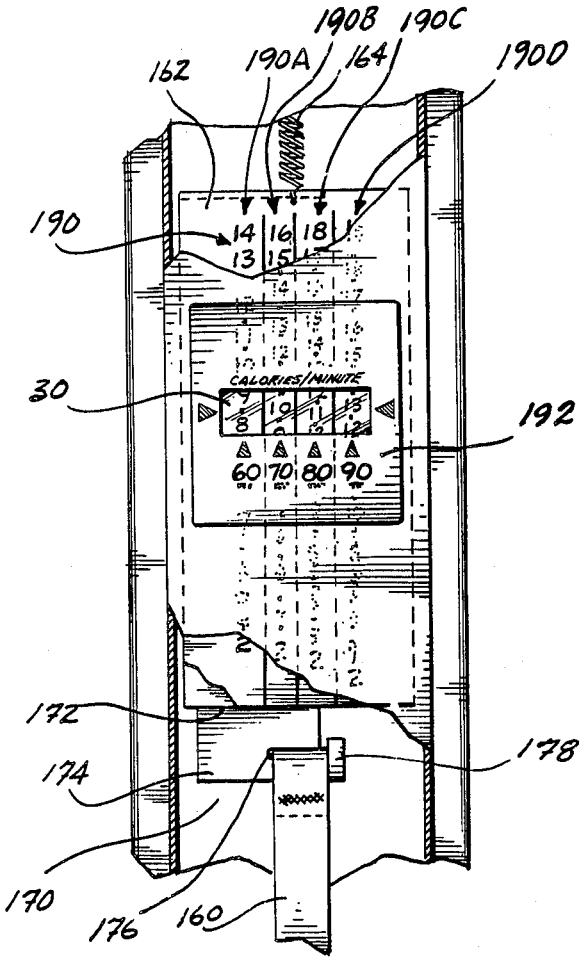

FIGS. 1 through 3 illustrate the application of the present invention in conjunction with a statonary exercise cycle 10. It is to be understood that the present invention can be employed in conjunction with other types of exercise apparatus wherein a circular member, such as a flywheel, is rotated during operation of the apparatus. Examples of such other exercise apparatus might include an exercise treadmill, a skiing exercise machine or a stair climbing exercise machine.

Referring initially to FIGS. 1 and 2, the exercise cycle 10 is constructed with a seat 12 adjustably mounted on an underlying frame assembly 14 at an elevation comparable to the elevation of a chair. The exercise cycle 10 also includes foot pedals 16 and associated pedal cranks 18 that rotatably drive a flywheel 20 through a chain drive system 22. A desired resistance load is applied to the flywheel 20 through a tensioning system 24 composed in part of a friction belt 26 extending about a substantial portion of the circumference of the flywheel 20. The level of workout or energy being expended by the individual operating the exercise cycle is measured by a novel ergometer 28 providing a visual display of the workout level through a window 30 formed in the top surface of the frame assembly 14 between the seat 12 and the pedal cranks 18.

Next, describing the above components of the exercise cycle 10 in more detail, the frame assembly 14 includes a frame structure 40 which also serves as a housing for the flywheel 20, drive train 22, flywheel tensioning system 24 and ergometer 28. The frame structure 40 includes an upright, rearward rectilinear section 42 disposed beneath the seat 12 and of sufficient size to house the flywheel 20. The frame structure 40 also includes a beam section 44 that cantilevers forwardly from the rectilinear section 42 at an elevation substantially midway of the height of the rectilinear section 42. Preferably, the frame structure 40 is constructed with a flange portion 46 extending along and inwardly of the perimeter of the frame structure whereby the frame structure is formed in a channel-shaped cross section.

The frame structure 40 also includes a ground-engaging base beam 50 underlying the frame rectilinear section 42 and extending forwardly partway along the length of the beam section 44. The base beam 50 is illustrated in FIG. 1 as being of rectangular cross section and substantially the same width as the thickness of frame structure 40; however, the base beam can be of other cross-sectional shapes and widths without departing from the scope and spirit of the present invention. The frame assembly 14 further includes a rear cross member 52 that extends a substantial distance outwardly from the frame structure 40. Preferably, the bottom surface of the cross member 52 is substantially coplanar with the bottom surface of the base beam 50 to cooperatively form a stable base for the exercise cycle 10. Although the cross member 52 is illustrated as being formed from circular, tubular material, it can be formed in other cross-sectional shapes, such as square or hexagonal, and from other types of materials, such as channel or angle members. Ideally, roller wheel 54 are mounted on the outer ends of the cross member 52 to enable cycle 10 to be conveniently moved about by simply lifting the forward end of beam section 44 and then either pushing or pulling the cycle to a new location.

Elongate, central side panels 58 extend horizontally along the central portion of the frame rectilinear section 42 and along the sides of the beam section 44. As described more fully below, the central panels 58 serve as structural support members and, thus, preferably are constructed from material of appropriate strength, such as a metal or high strength plastic. To facilitate the assembly of cycle 10, preferably the central panels 58 are detachably fastened to the frame structure 40 by any convenient means, such as by hardware members, not shown. A central cover panel 59 is used to overlie panel 58, and upper and lower side panels 60 and 62 are used to cover the sides of the frame rectilinear section 42 extending above and below, respectively, the central side panel 58. As shown in FIG. 1, the forward ends of the upper and lower side panels 60 and 62 are beveled to match the corresponding angulation of the frame rectilinear section 42. Since panels 59, 60 and 62 are non-structural, they may be made from any convenient materials, such as plastic. Alternatively, these panels could be made from metal thereby to serve as a structural component of the frame assembly 14.

The seat 12 is composed of a padded, contoured base 70 and a padded, contoured back rest 72 supported by a post 74. The base 70 is mounted on a longitudinal carriage 76 which is generally channel-shaped in cross section to slidably engage over a guide rail or tube 78, spaced slightly above the rectilinear section 42 of the frame structure 40 by a spacer plate 79 to define a narrow gap 80 between the guide rail and the rectilinear section about the perimeter of the guide rail. As shown in FIG. 2, the carriage 76 includes lower flange portions 81 that extend inwardly into the gap 80 to underlie the lower side edges of the guide rail 78 to prevent the carriage from disengaging from the guide rail in the upward direction. The seat 12 may be locked in place at discrete locations along the length of the guide rail 78 by a pin 82 that is spring biased to engage within one of a series of holes 84 formed in the sidewall 85 of the guide rail 78. The pin 82 is mounted within an exterior barrel 86 that is fixed to the sidewall of the carriage 76. The pin 82 is spring biased into engagement with the holes 84. Preferably, the pin 82 is formed with an enlarged head portion to aid in grasping the pin to pull it back against the spring bias when it is desired to change the position of the seat 12. A pair of handlebars 88 are spaced outwardly and extend forwardly along and parallel to the forward side portions of the seat base 70. The rearward ends of the handlebars 88 are fixedly attached to arms 90 that extend transversely outwardly from the underside of a base plate 91 of the seat 70, FIG. 2. For comfort, preferably resilient handgrips 92 are engaged over at least the forward portions of the handlebars 88. The handgrips 92 may be formed from resilient foam material or other suitable materials.

As noted above, ideally the elevation of the seat 12 generally corresponds to the height of the seat of a standard chair, thereby facilitating access to the cycle 10, especially for ill, injured or otherwise infirmed individuals. Moreover, the convenient placement of the handlebars 88 permits users to operate the cycle 10 without fear of falling off of the seat 12.

Next, describing in greater detail the drive system 22 of the present invention, as most clearly shown in FIG. 2, the flywheel 20 is in the form of a circular disk oriented to rotate about a horizontal axis in the rectilinear section 42 of the frame structure 40 in the clockwise direction as indicated by arrow 94. The flywheel 20 is rotatably mounted on a driven shaft 100 through the intermediacy of roller bearings, not shown, disposed within the central hub portion of the flywheel. The outer ends of the driven shaft 100 are supported by the central panels 58 of the frame structure 40. As is common in stationary exercise cycles, a one-way clutch, not shown, is disposed within the central hub portion of flywheel 20 between the roller bearings, not shown, and the driven shaft 100. The one-way clutch locks the flywheel 20 to the driven shaft 100 when the driven shaft is being driven by rotation of the pedals 16. Correspondingly, the one-way clutch disengages the flywheel from the driven shaft when the driven shaft 100 is no longer being driven, thereby enabling the flywheel to freewheel. One-way clutches are standard articles of commerce.

The drive system 22 also includes a driven sprocket 102 antirotationally secured to the driven shaft 100 at a location closely beside the flywheel 20. A substantially larger drive sprocket 104 is antirotationally mounted on a drive shaft 106, which is antifrictionally journaled on flange bearings 108 mounted on the forward ends of the central side panels 58 of the frame structure 40. The ends of the drive shaft 106 extend transversely outwardly from the central panels 58 to receive pedal cranks 18. Preferably, the pedal cranks are of the same type as used on bicycles and include foot-engaging pedals 16 rotatably mounted on the cranks. A drive chain 108 is trained on the drive sprocket 104 and driven sprocket 102 to transmit torque therebetween. It is to be understood that rather than utilizing the drive sprocket 104, the driven sprocket 102 and an associated drive chain 108, these components may be replaced by a V-type drive belt or other type of belt and belt pulleys or even by gears and interconnecting drive shafts without departing from the spirit or scope of the present invention.

As illustrated in FIGS. 1 and 2, the drive shaft 106 is located at an elevation approximately halfway between the bottom of the cycle 10 and the height of the seat 12 so that the vertical distance between the seat 12 and the pedals 16 is substantially less than in a conventional bicycle. As such, the rider is disposed in a comfortable, semi-recumbent position with his weight distributed substantially evenly across his buttocks and lower back. Also, because the rider's legs are closer to the same elevation as his heart, the blood pressure of the rider is lower than when pedaling a standard upright exercise cycle or riding a bicycle.

Next, describing the construction of the flywheel tensioning system 24, as shown in FIG. 2, an endless friction belt 26 rides within a shallow groove formed around the periphery of the flywheel 20 for imposing a desired resistance load on the flywheel thereby to achieve the particular level of pedal effort desired by the rider. The tension on the friction belt 26 is conveniently and selectively adjusted by rotation of a hand knob 110 located on the upper inclined surface 112 interconnecting frame rectilinear section 42 with beam section 44. The knob 110 is secured to the upper end of a threaded shaft 114 extending downwardly through the frame inclined surface 112 in a direction substantially perpendicular to the surface. The shaft 114 threadably engages within a nut 116 fixedly secured to a bracket 118 which underlies an intermediate portion of a formed pivot beam assembly 120. The bracket 118 includes upwardly extending side flanges 119 that laterally retain the pivot beam assembly therebetween.

In one preferred embodiment of the present invention, the pivot beam assembly 120 is composed of a pair of spaced apart, parallel formed wire members 122 having a generally dog-legged shape in side profile. At one end, the wire members 122 are formed into loops or eyes for engaging around a pulley shaft 124, which extends through a central bore formed in a take-up pulley 126 around which the belt 26 rides. Pulley 126 is formed with integral end flanges to prevent the belt 26 from disengaging therefrom. Locking nuts, or other appropriate hardware members 128, are engaged with the ends of the shaft 124 to retain the looped ends of the wire members 122 engaged on the shaft 124. Loops or eyes, are also formed in the opposite ends of the wire members 122 to engage over a pivot shaft 128 extending transversely through the frame structure 40 to be supported by the frame structure central panels 58. The looped ends of the wire members 122 are interposed between a central idler pulley 130 mounted on the pivot shaft 128 and outer pulleys 132 that serve as spacers for the central pulley.

It will be appreciated that as the adjustment knob 110 is rotated, the wire members 122 are pivoted about pivot shaft 128 thereby to increase or decrease the center-to-center distance between the flywheel driven shaft 100 and the belt pulley shaft 124 thereby increasing or decreasing, respectively, the tension on the friction belt 26, as desired. When the friction belt 26 is tensioned, the wire members 122, being somewhat elastic, will bend thereby permitting the knob 110 to be rotated through more revolutions for a given range of belt tension than would be possible if the wire members were formed substantially rigid. This permits the tension on the belt 26 to be more finely or precisely selected than otherwise would be possible if the wire members 122 were substantially rigid. Preferably, the wire members 122 are formed from spring wire, or similar height strength but resilient material. It is to be appreciated that the pivot beam assembly 120 may be constructed from structural members other than the wire members 122 and still function in the desired manner described above.

Ideally, the flywheel 20 is sized and the step-up drive ratio produced by sprockets 102 and 104 is selected so that when the flywheel is rotated by operation of the pedals 16, the momentum of the revolving flywheel approximates the momentum of a moving bicycle, together with its rider. In this manner, the drive system 22 of the present invention simulates the pedaling of a bicycle. Applicants have found that this desired stimulation is substantially achieved by constructing the flywheel from steel with an outer diameter of approximately 14.20 inches, and a weight of approximately 40 pounds. Ideally, the flywheel includes the center section approximately 0.22 inch thick and a thicker outer rim approximately 1.25 inches across and 3.00 inches wide in a radial direction. The step-up drive ratio achieved by sprockets 102 and 104 is approximately 2.5:1.

The revolutions of the flywheel 20 are monitored so that the speed and the distance pedaled by the rider may be determined. To this end, a magnet 140 is mounted on the side of the flywheel 20 opposite the driven sprocket 102 by any appropriate means. A magnet sensor 142 is mounted on the adjacent central panel 58 of the frame structure 40 in alignment with the circle defined by the magnet 140 during rotation of the flywheel. Each time the magnet 140 passes by the sensor, an electrical signal is transmitted from the sensor through lead wires 144 to a microprocessor, not shown, disposed within a housing 146 positioned on the upper surface 147 of the beam section 44 of frame 40, slightly forward of window 30. The microprocessor uses the signals from the sensor 142 to compute the distance pedaled by the rider. The microprocessor also includes a time signal generator, not shown, that is employed to compute the speed of rotation of the flywheel and the elapsed time of the workout. These parameters are shown on an electronic display 148 mounted on the housing 146. As is well known in the art, to minimize electrical energy needed to operate the display 148, such displays are preferably in the form of liquid crystal displays or a light-emitting diode.

Control buttons 150 and 152 are provided to activate and deactivate the microprocessor and the display 148. Additional control buttons 154 and 156 are provided to enable the rider to select the desired parameter to be displayed. Preferably, the microprocessor and the display are powered with an electrical battery, not shown, disposed within the housing 146 to permit the exercise cycle 10 to be portable rather than having to be located near an electrical output plug. Microprocessors and time signal generators, as employed in the present invention and discussed above, are standard articles of commerce.

The present invention also employs a novel ergometer 28 to measure the work being expended by the rider during pedaling of the cycle 10. Referring to FIGS. 2 and 3, the ergometer 28 includes a line or strap 160 that is adhered, stitched, or otherwise attached to friction belt 26 at a location along the forward rim of the flywheel 20 as viewed when sitting on the seat 12 (i.e., the right-hand side of the flywheel in FIG. 2) so that the strap extends substantially tangentially from the flywheel in the upwardly direction. From this tangential departure from flywheel 20, the strap extends about the central idler pulley 130 that is antifrictionally engaged over pivot shaft 128 and then horizontally forwardly for connection to the rear end of a sliding, formed indicator plate 162. The opposite, forward end of the indicator plate 162 is secured to the rear end of a precision extension spring 164, with the forward end of the extension spring being anchored to the forward wall 166 of the beam section 44.

Although the entire length of belt 26 may be constructed from a singular material, such as woven nylon, ideally the belt 26 is composed of two separate materials, i.e., a major section **26*a* composed of matted Dacron sold under the trade name Nova 25 by Siegling Belt Company and a minor section 26*b* composed of woven nylon. Preferably, the major section 28*a* is in contact with the flywheel 20 whereas the minor section 26*b*, being more flexible than the major section, trains around the take-up pulley 126. The major section 26*a* and minor section 26*b* of the belt 26 may be connected together by any appropriate means, such as by stitching 26*c*, FIG. 2. Applicants have found that constructing belt major section 26*a* from matted Dacron material results in greater heat resistance, quieter operation and a more uniform coefficient of friction relative to constructing the belt 26 entirely from woven nylon material. Because of the substantially greater stiffness of the Dacron belt material in relation to the woven nylon material, preferably the minor section 26*b* of the belt 26 is composed of woven nylon material to properly train around the small diameter of pulley 126. Likewise, ideally the loop 160 is composed of woven nylon or similar material to compliantly train around central the idler pulley 30. It is to be understood that rather than forming strap 60 from the flat, woven nylon or similar material, it could be formed from a woven cord or from solid, flexible line material as long as the strap/line does not elongate under the load imparted thereon by the spring 164**.

The indicator plate 162 is constructed with a flat, major section 168 having a width slightly narrower than the interior width of beam section 44. The indicator plate 162 includes a rearward, formed hook section 170 composed of a vertical leg 172 extending downwardly from the rear edge of the plate major section 168 and a horizontal leg 174 extending rearwardly from the lower edge portion of the vertical leg 172. A narrow slot 176 extends inwardly from one edge of the horizonjtal leg 174 for reception of a loop formed in the forward end of the strap 160, for instance, by simply doubling the end of the strap over on itself and then stitching, adhering or otherwise affixing the end to the strap to form the loop. A tab 178 extends forwardly across the open end of the slot 176 to prevent disengagement of the strap 160 from the slot. It is to be understood that strap 160 may be connected to indicated plate 162 by other convenient means without departing from the spirit and scope of the present invention.

A bracket 180 extends downwardly from the forward edge portion of the plate major section 168. An aperture extends through the lower portion of the bracket 180 for reception of a hook formed in the rear portion of the extension spring 164. It will be appreciated that by the foregoing construction, the indicator plate 162 shifts or moves in the fore-and-aft direction along the length of beam section 44 and responds to the movement of strap 160, discussed more fully below. For free movement of the indicator plate 162, support roller assemblies 184 are disposed beneath the indicator plate. Each of the support roller assemblies 184 includes a roller 186 antifrictionally mounted on a stub shaft 188 attached to the upper flange of the beam section 44, whereby the rollers 186 contact against the edge portions of the bottom side of the indicator plate major section 168 to support the indicator plate at an elevation just below window 30.

Next, referring specifically to FIG. 3, sets of indicia 190 are disposed on the upper surface of the major section 168 of the indicator plate 162 in four columns 190A, 190B, 190C and 190D. Preferably, the indicia 190 are in the form of arabic numerals corresponding to the calories per minute being expended by the cycle rider, with the indicia in each of the four columns corresponding to a different rotational speed of the flywheel 20. These rotational speeds are indicated by a second set of indicia 192 disposed on the upper surface 147 of the beam section 44 adjacent the window 30 and in alignment with corresponding columns 190A, 190B, 190C and 190D. As previously discussed, the rotational speed of the flywheel is ascertained from the display 148 associated with the microprocessor housing 146.

In the operation of the cycle 10, a desired workout level in terms of calories per minute is preselected as well as a desired rotational speed for flywheel 20. Thereafter, the knob 110 is adjusted while pedals 16 are being operated at the desired rotational speed of the flywheel until the proper drag is achieved between belt 26 and flywheel 20 corresponding to the preselected calories per minute desired to be expended by the rider, which is conveniently visible through window 130. The frictional drag between belt 26 and flywheel 20 tends to cause the belt to rotate in the clockwise direction in FIG. 2 with the flywheel. However, this rotational tendency is resisted by the belt 160 extending tangentially upwardly from the flywheel thereby generating a tensile load in the belt corresponding to the torque load on the flywheel generated by the belt. This tensile load on belt 160 is transmitted to the extension spring 164 through the intermediacy of the indicator plate 162. Thereupon, the spring 164 extends a distance corresponding to the frictional force between the belt 126 and the flywheel 20 being resisted by the strap 160. Because the spring 164 is designed to exhibit a linear spring rate along its operating range, the distance that indicator plate 162 has shifted coincides with the resistance force imposed on strap 160 by the spring 164 which, in turn, is equal to the frictional force acting between strap 26 and flywheel 20. As a result, the workout level, or work being expended by the cycle rider accurately corresponds to the particular indicia 190, displayed through the viewing window 30, of the column 190A–190D matching the rotational speed of the flywheel which is conveniently ascertained from electronic display 148.

It will be appreciated that the tensile force imposed on the strap 160 actually corresponds to the frictional load imposed on the flywheel 20 by the belt 26, which is a true measure of the work being expended by the rider, rather than sensing only the tension on the belt 26. The tension on the belt 26 for a given frictional force between the belt and the flywheel is dependent upon the coefficient of friction acting between the belt and the flywheel. This coefficient in turn is dependent upon numerous factors that may vary over time, for instance, the extent to which the belt 26 is worn, the cleanliness of the belt, the moisture content of the belt, the temperature of the belt. These factors, on the other hand, do not affect the spring rate of spring 164 to any appreciable amount. Thus, the length to which the spring 164 is extended provides a very precise indication of the work being expended by the cycle rider.

By the foregoing construction, the ergometer 28 provides an accurate measurement of the work being expended by the cycle rider without requiring fragile or expensive electrical or other types of components, which otherwise would be needed to measure the workout level with the same accuracy provided by the ergometer of the present invention.

It is to be understood that the extension spring 164 may be replaced with other types of resilient resistance devices without departing from the present invention. Examples of such alternative resistance devices may include, a compression spring, a torsion spring, a coil spring, a beam loaded in bending, etc.

As will be apparent to those skilled in the art which the invention is addressed, the present invention may be embodied in forms other than those specifically disclosed above without departing from the spirt and essential characteristics of the invention. The particular embodiments of the exercise cycle 10 and the ergometer 28, described above, are therefore to be considered in all respects as illustrative and not restricted. The scope of the present invention is as set forth in the appended claims, rather than being limited to the foregoing description.

The embodiments of the invention in which an exclusive property or privilege is claimed are defined as follows:

1. An ergometer for an exercise apparatus having a circular member rotated during operation of the apparatus, said ergometer comprising:

(a) a continuous friction belt means extending around at least a portion of the circumference of the circular member;

(b) means for applying tension on the belt means to impart a desired friction load between the belt means and the circular member and simultaneously permitting the tensioned belt means to rotate with the rotating circular member;

(c) line means fixedly connected to the belt means to extend tangentially to the circumference of the circular member;

(d) elastic resistance means connected to the line means opposite the circular member to resist movement of the line means under the influence of the frictional force between the belt means and circular member; and, (e) indicator means movable with the movement of the line means with the distance of movement of the indicator means corresponding to the energy being expended by the apparatus operator.

2. The ergometer of claim 1, wherein the circular member comprises a flywheel.

3. The ergometer of claim 1, wherein the belt means is endless.

4. The ergometer of claim 3, wherein the line means is composed of the same material as the belt means.

5. The ergometer of claim 1, wherein the line means is composed of substantially the same material as the belt means.

6. The ergometer of claim 1, wherein the tension means has portions elastically interconnecting the tension means to the belt means.

7. The ergometer of claim 6, wherein said tension means includes:

an elastic beam structure pivotally anchored at a first end thereof and connected to the belt means at a location distal from its first end; and, means for pivoting the beam structure about the first end to impart a desired load on the belt means.

8. The ergometer according to claim 7, wherein the beam structure is composed of resilient material.

9. The ergometer of claim 7, wherein the beam structure is composed of spring wire material.

10. The ergometer of claim 1, wherein the indicator means include a scale having indicia related to the work being expended by the operator of the apparatus.

11. The ergometer according to claim 10, further comprising sets of indicia related to the work being expended by the operator of the apparatus at different rotational speeds of the circular member.

12. The ergometer according to claim 10, wherein the indicator means comprises a plate portion movable with the movement of the line means, the indicia disposed on said plate portion to indicate the amount of movement of said plate portion which in turn indicates the work being expended by the apparatus operator.

13. The ergometer according to claim 12, wherein the line means is connected to one end portion of the plate portion and the resistance means are connected to an opposite end portion of said plate portion.

14. The ergometer according to claim 13, wherein the resistance means comprise spring means.

15. The ergometer according to claim 14, wherein the spring means include an extension spring.

16. The ergometer according to claim 12, wherein the indicia are positioned along the plate in the direction of movement of the plate.

17. The ergometer according to claim 16, further comprising sets of indicia extending along the plate in the direction of movement of the plate, with the sets of indicia corresponding with different rotational speeds of the circular member.

18. The ergometer according to claim 12, further comprising antifriction means supporting and constraining the plate for antifrictional movement.

19. An exercise apparatus comprising:

(a) a circular rotatable member rotated during operation of the apparatus;

(b) a continuous belt means extending around at least a portion of the periphery of the rotatable member;

(c) means for applying tension to the belt means to impart a desired frictional load between the belt means and the rotatable member and simultaneously permitting the tensioned belt means to rotate with the rotating rotatable member;

(d) resistance means fixedly;

(e) line means interconnecting the resistance means to the belt means at a location approximately tangentially to the rotatable member during rotation of the rotatable member whereby the resistance member imparts a load on the line means corresponding to an opposite load being imparted on the line means by the belt means in response to the frictional force existing between the belt means and the rotating rotatable member; and (f) indicator means indicating the level of resistance being applied to the line means by the resistance means which in turn corresponds to the level of work being expended by the operator of the exercise apparatus.

20. The exercise apparatus according to claim 19, wherein the rotatable member comprises a flywheel.

21. The exercise apparatus according to claim 20, wherein the belt means is endless.

22. The exercise apparatus according to claim 19, wherein the belt means is endless.

23. The exercise apparatus according to claim 19, wherein the indicator means includes indicia related to the level of work being expended by the operator of the exercise apparatus.

24. The exercise apparatus according to claim 23, further comprising sets of indicia for indicating the level of work being expended by the exercise apparatus operator at different rotational speeds of the rotatable member.

25. The exercise apparatus according to claim 23, wherein the indicator means moves with the movement of the belt means, and the indicia are positioned along the direction of movement of the indicator means.

26. The exercise apparatus according to claim 19, wherein the indicator means are located within the exercise apparatus, and the exercise apparatus includes a viewing window to view the indicator means.

27. The exercise apparatus according to claim 19, wherein said indicator means is disposed between the resistance means and the line means.

28. The exercise apparatus according to claim 27, wherein the resistance means comprises spring means.

29. A stationary exercise cycle comprising:

(a) a flywheel rotated by the operator of the exercise cycle during operation of the exercise cycle;

(b) a continuous friction belt means extending around at least a portion of the circumference of the flywheel;

(c) means for applying tension on the belt means to impart a desired friction load between the belt means and the flywheel, thereby tending to cause the belt means to rotate with the rotating flywheel;

(d) line means fixedly connected to the friction belt means and extending tangentially from the flywheel;

(e) resistance means acting through the line means to resist the tendency of the friction belt means to rotate with the rotating flywheel; and, (f) indicator means measuring the level of resistance applied to the friction belt means by the resistance means thereby monitoring the level of work being expended by the rider of the stationary exercise cycle.

30. The stationary exercise cycle according to claim 29, wherein the belt means is endless.

31. The stationary exercise cycle according to claim 30, wherein the line means is composed of the same material as the belt means.

32. The stationary exercise cycle according to claim 29, wherein the tension means includes elastic means for interconnecting the tension means to the belt means.

33. The stationary exercise cycle according to claim 29, wherein the indicator means includes indicia related to the level of work being expended by the rider of the cycle.

34. The stationary exercise cycle according to claim 29, wherein the indicator means includes sets of indicia related to the work being expended by the operator during operation of the exercise cycle at different speeds.

35. The indicator means according to claim 29, comprising an elongate member interconnected to the line means for shifting longitudinally a distance related to the level of energy being expended by the operator of the exercise cycle, the elongate member having indicia thereon for visually observing the longitudinal distance that the elongate member has shifted.

36. The indicator means according to claim 29, comprising an elongate member interconnected to the resistance means for shifting longitudinally a distance related to the level of energy being expended by the operator of the exercise cycle, the elongate member having indicia thereon for visually observing the longitudinal distance that the elongate member has shifted.

37. The stationary exercise cycle according to claim 29, wherein the indicator means is disposed between the line means and said resistance means to shift with the movement of the line means in response to the friction force between the belt means and the flywheel.

38. The stationary exercise cycle according to claim 37, wherein the elongate member includes indicia spaced therealong to visually indicate the distance that the longitudinal member has shifted in response to the friction force between the belt means and the rotating flywheel.

39. The stationary exercise cycle according to claim 29, wherein the resistance means includes spring means.

* * * * *

UNITED STATES PATENT AND TRADEMARK OFFICE

CERTIFICATE OF CORRECTION

PATENT NO. : 4,770,411

DATED : September 13, 1988

INVENTOR(S) : Armstrong et al.

It is certified that error appears in the above-identified patent and that said Letters Patent is hereby corrected as shown below:

Column 1, line 63, "miroprocessor" should be -- microprocessor --

Column 3, line 24, "statonary" should be -- stationary --

Column 8, line 34, "horizonjtal" should be -- horizontal --

Column 11, line 38, delete "fixedly"

Signed and Sealed this

Seventh Day of March, 1989

*Attest:*

DONALD J. QUIGG

*Attesting Officer*

*Commissioner of Patents and Trademarks*